US007717324B2

(12) United States Patent
Keefe, Jr.

(10) Patent No.: US 7,717,324 B2
(45) Date of Patent: May 18, 2010

(54) SHIPPING AND DISPLAY CONTAINER WITH REMOVABLE COVER AND THE ASSOCIATED CONTAINER BLANK

(75) Inventor: Walter D Keefe, Jr., Carol Stream, IL (US)

(73) Assignee: International Paper Company, Memphis, TN (US)

( * ) Notice: Subject to any disclaimer, the term of this patent is extended or adjusted under 35 U.S.C. 154(b) by 200 days.

(21) Appl. No.: 11/864,032

(22) Filed: Sep. 28, 2007

(65) Prior Publication Data

US 2009/0084706 A1 Apr. 2, 2009

(51) Int. Cl.
*B65D 17/28* (2006.01)
*B65D 5/52* (2006.01)

(52) U.S. Cl. ..... 229/240; 206/736; 229/160.2

(58) Field of Classification Search ..... 229/235, 229/240, 242, 160.2; 206/736, 766, 774
See application file for complete search history.

(56) References Cited

U.S. PATENT DOCUMENTS 3,917,158 A * 11/1975 Dorofachuk et al. ..... 229/240
4,113,100 A * 9/1978 Soja et al. ..... 229/235
4,228,899 A * 10/1980 Austin, Jr. ..... 229/160.2
4,815,609 A * 3/1989 Kiedaisch ..... 229/235
5,651,497 A * 7/1997 Ventura et al. ..... 229/235
5,881,884 A * 3/1999 Podosek ..... 206/774
6,386,369 B2 * 5/2002 Yuhas et al. ..... 229/242
6,435,351 B1 * 8/2002 Gibb ..... 229/242
6,755,306 B2 * 6/2004 Maus ..... 206/774
6,974,033 B2 * 12/2005 McLeod et al. ..... 206/736
6,981,632 B2 * 1/2006 Gardner et al. ..... 229/240
7,097,093 B2 * 8/2006 Darin et al. ..... 229/160.2
7,175,066 B2 * 2/2007 Varanasi ..... 229/235
7,451,878 B2 * 11/2008 Rochefort et al. ..... 229/235
2005/0092822 A1 * 5/2005 Sutherland ..... 229/235
2007/0102497 A1 * 5/2007 Borek et al. ..... 229/242

* cited by examiner

*Primary Examiner*—Gary E Elkins

(57) ABSTRACT

The embodiments of the present invention provide a blank of foldable material configurable to form a container. When formed, the container includes a removable top portion of panel assemblies that converts the container from shipping container to a display container.

6 Claims, 5 Drawing Sheets

SHIPPING AND DISPLAY CONTAINER WITH REMOVABLE COVER AND THE ASSOCIATED CONTAINER BLANK

FIELD OF INVENTION

This invention related generally to cellulose-based blanks and containers and more specifically to wood cellulose-based blanks and containers used for shipping and displaying goods.

BRIEF DESCRIPTION OF THE DRAWINGS

Various embodiments of the present invention are described in detail below with reference to the following FIGURES.

DETAILED DESCRIPTION

The present invention provides a blank and resulting container for shipping and displaying a variety of goods. By way of overview, and with reference to the FIGS. 1 through 5, an embodiment of the present invention includes a single piece blank 20 of formable material arranged to form a container 50. Specific details of the blank 20 and container 50 are described in more particularity below.

Figure 1:
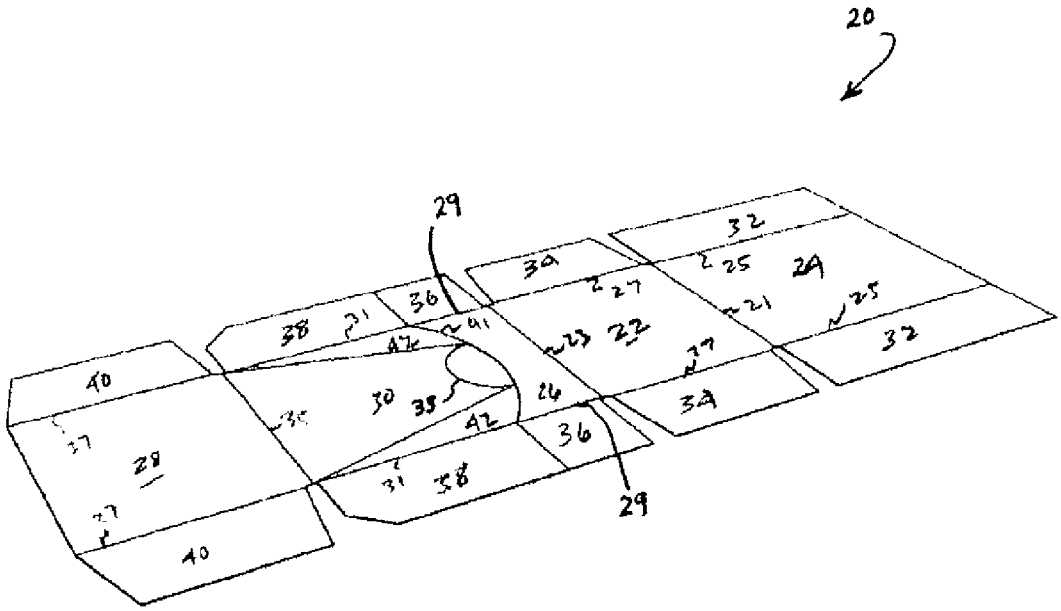
FIG. 1 is a plan view of a single piece container blank formed in accordance with an aspect of the present invention.
Figure 2:
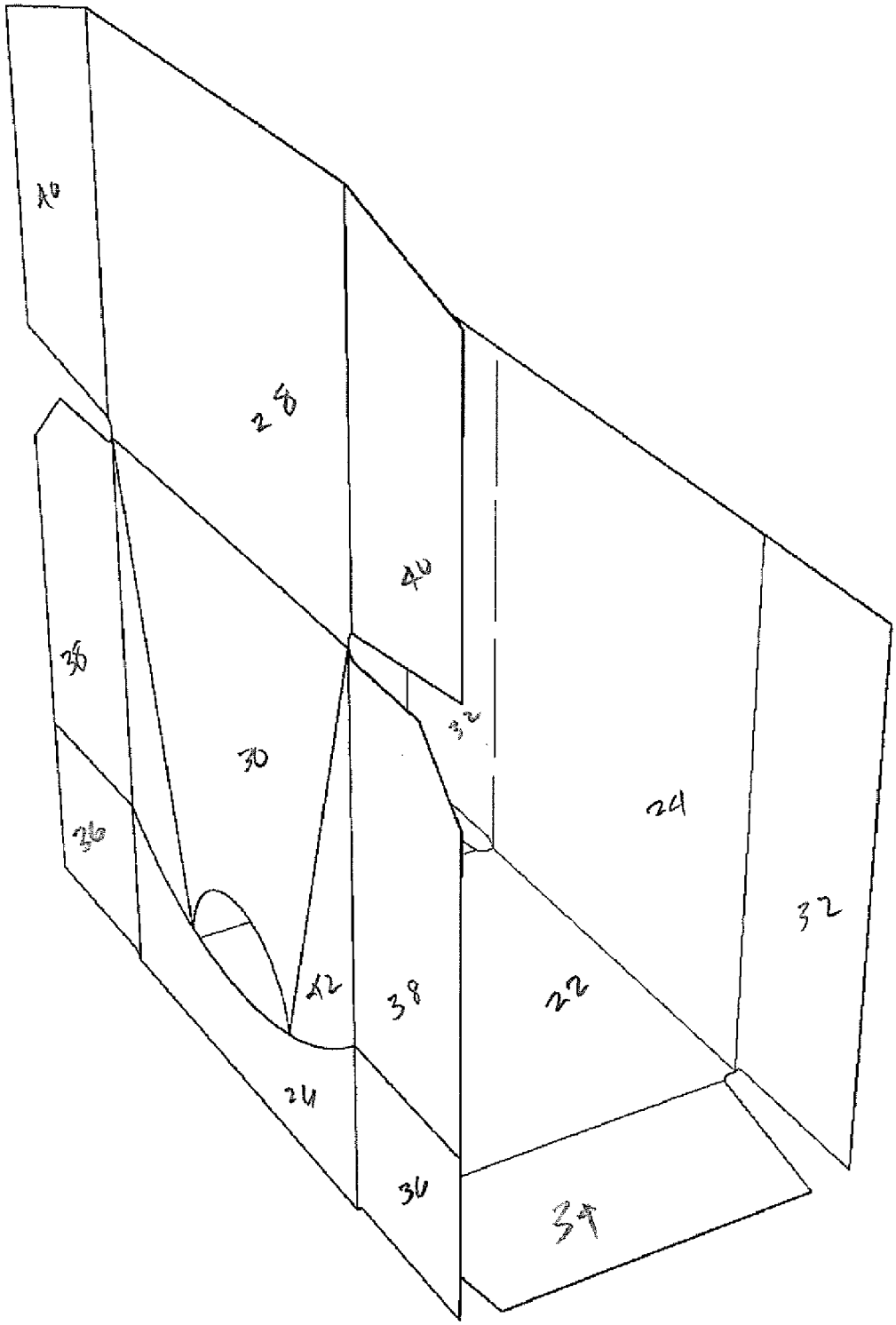
FIG. 2 is a perspective view of a partially assembled container assembled according to an aspect of the present invention.

FIG. 1 depicts a blank 20 used to form container 50. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard, and paperboard. The blank 20 is cut and scored, perforated or otherwise formed to include a plurality of panels that when assembled form container 50. In all FIGURES, like numbers indicate like parts. Additionally, cut lines are shown as solid lines, score lines as dashed lines, and lines of perforation as broken lines.

FIG. 1 depicts the blank 20 made in accordance with an aspect of the present invention. The blank 20 includes a bottom panel 22. The bottom panel 22 is either square or rectangular in shape. The bottom panel 22 is bounded by fold lines 21 and 23 and opposed fold lines 27. Connected with the bottom panel 22 along the fold line 21 is a rear panel 24. The rear panel 24 is bounded in part by opposed fold lines 25. The first side panels 32 are connected with rear panel 24 along the respective fold lines 25.

Connected with the bottom panel 22 along a fold line 23 is a front panel 26. Front panel 26 is in part defined by opposed fold lines 29. Third side panels 36 are connected with the front panel 26 along those fold lines 29.

Connected with the front panel 26 are front access flaps 42. The front access flaps 42 are connected to the front panel 26 along perforation line 41. Front access panel 30 is also connected to the front panel 26 via a perforated line 41 and is partially defined at one end by a cut line 33. Connected with the front access flaps 42 are side access panels 38.

A top panel 28 is connected with the front access panel 30 along a fold line 35. The top panel 28 also includes opposed top flaps 40 that are connected with the top panel 28 along fold lines 37.

Figure 3:
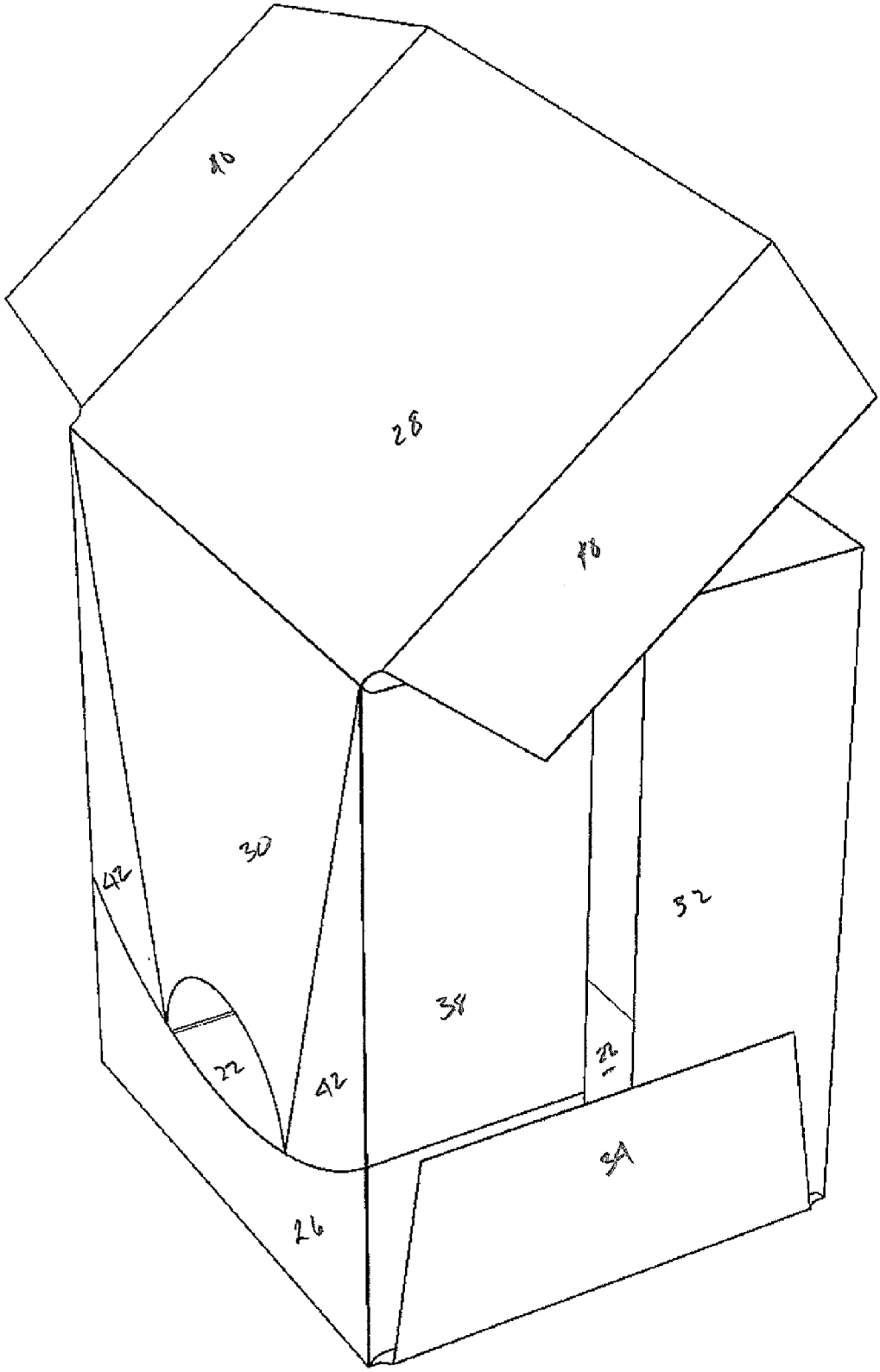
FIG. 3 is another perspective view of a partially assembled container assembled according to yet another aspect of the present invention.
Figure 4:
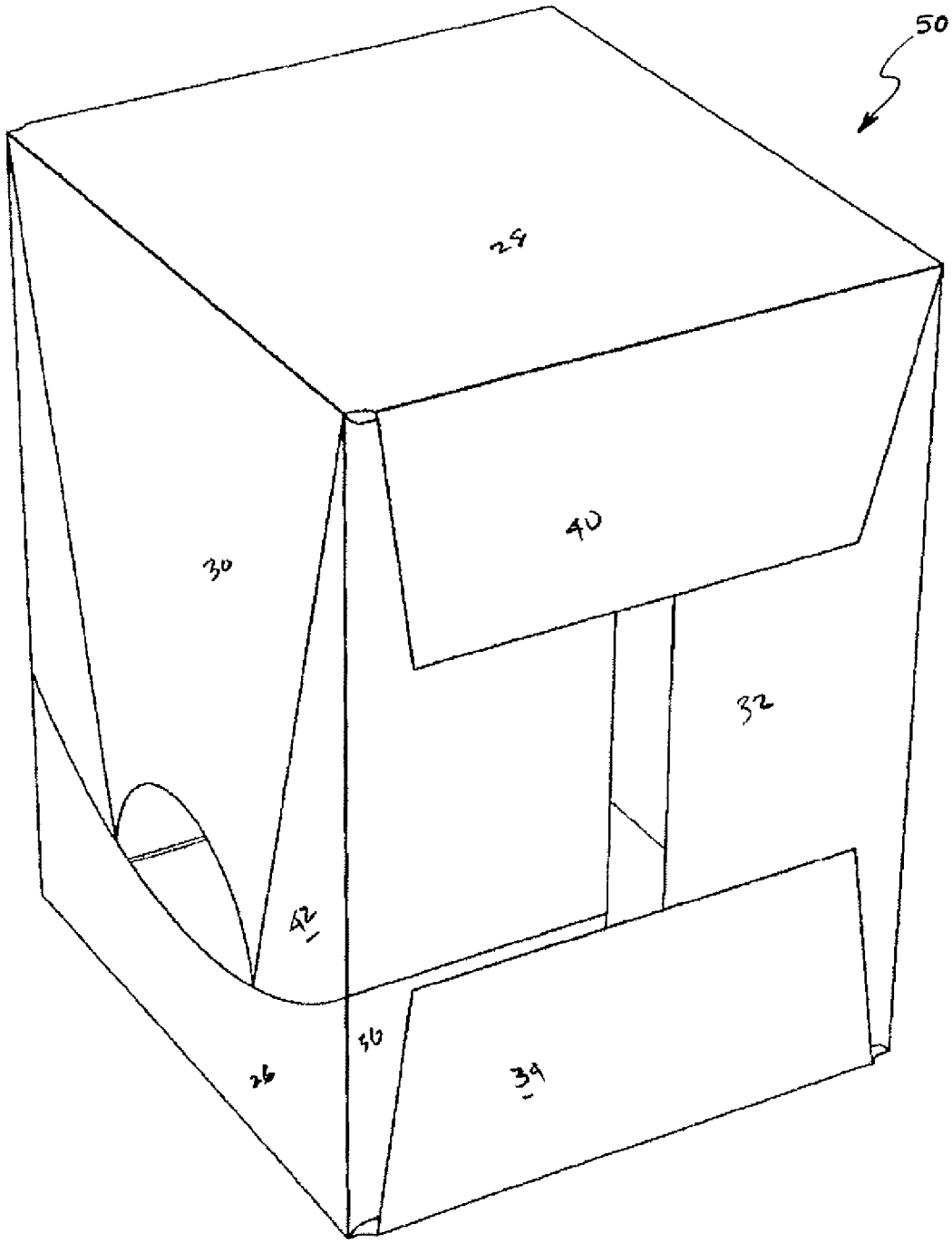
FIG. 4 is yet another perspective view of a partially assembled container assembled according to a further aspect of the present invention; and, FIG. 5 is a perspective view of the assembled container blank of FIG. 1.

With references to FIGS. 2 through 5, erection of the container and exemplary container features are depicted. The rear panel 24 may be folded upwardly approximately 90 degrees along a fold line 21. Likewise front panel 26 may be folded upwardly approximately 90 degrees along a fold line 23. The side panel 36 and side access panels 38 may be folded inwardly approximately 90 degrees along fold lines 29 and 31. Likewise first side panels 32 may be folded inwardly along fold line 25. Further, second side panels 34 may be folded upwardly approximately 90 degrees along fold line 27 to substantially close the lower portion of the container as best depicted in FIG. 3.

It will be appreciated that as these various panels may be held in place by any variety of fastening means known in the industry. Suitable, non limiting examples of such fasteners includes glue or other adhesive, tape, staples or combinations thereof. As fasteners are known in the industry, a detailed description is not necessary herein.

To "close" the container 50, top panel 28 may also be folded inwardly along fold line 35. Subsequently top flaps 40 may be folded downwardly approximately 90 degrees along fold line 37 to bring the panel top flaps 40 into a juxtaposed position with the side access panel 38 and the first side panel 32 as best viewed in FIG. 4. At this stage the container 50 is substantially closed and may be shipped or moved around and placed on display shelves.

Figure 5:
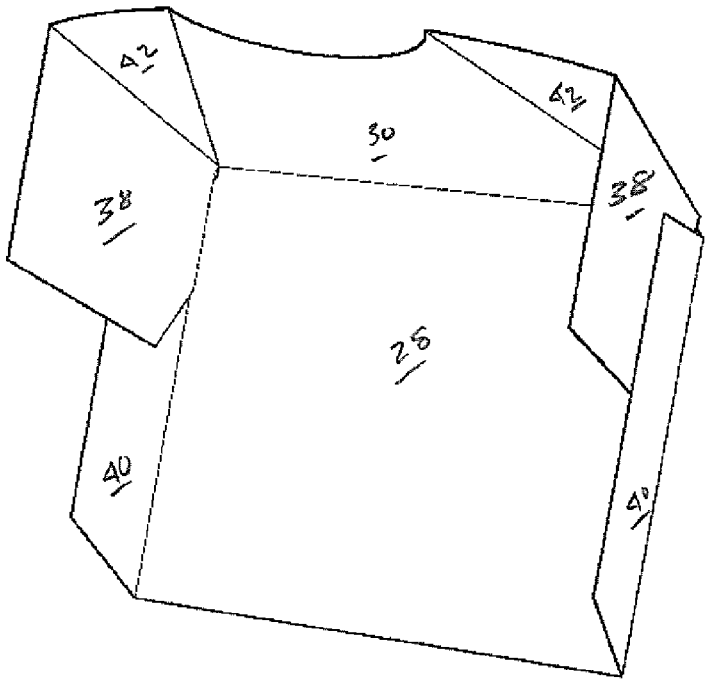
Figure 5:
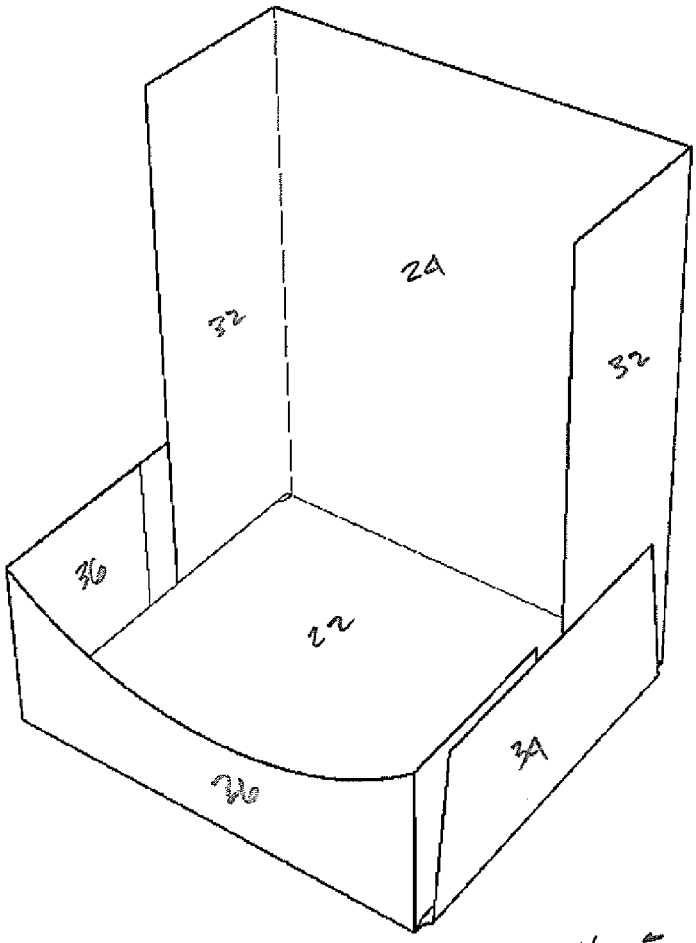

As seen in FIG. 5, another aspect of the present invention is disclosed. Specifically, the "open" or "display" state of the container 50 is shown. The container 50 is "display ready" by taking off top panel 28, front access panel 30, top flaps 40, side access panel 38 and front access flaps 42 all in a single unit. The remaining portion of the container 50 is set to display any variety of products (not shown) on a store shelf or other location.

A variety of additional elements may be included, such as, without limitation, vents, specialized liners or grease barriers, etc., without departing from the spirit and scope of the present invention. Similarly, rounding or otherwise trimming of various panels is considered within the scope of this invention.

While various embodiments of this invention have been illustrated and described as noted above, many changes can be made without departing from the spirit and scope of this invention. Accordingly, the scope of the invention should be determined entirely by reference to the claims that follow.

What is claimed is:

1. A single sheet of foldable material cut and scored to define a container, comprising:

a bottom panel having a pair of second side panels being defined by two parallel fold lines, the bottom panel being foldably connected to a front panel and a rear panel, the front panel includes a pair of side panels and the rear panel includes a pair of first side panels wherein the bottom panel together with the pair of second side panels, the front panel, the rear panel, the pair of side panels, and the first side panels form an interior space to contain products to display; and a top panel being formed opposite the bottom panel, the top panel being foldably connected to a pair of top panel flaps, a front access panel foldably connected to the top panel, the front access panel including two substantially similar front access flaps defined by two unparallel fold lines, said front access flaps each including an arcuate edge detachably connected to the front panel by a perforated line, the front access flaps being bounded by two side access panels and wherein the top panel together with the top panel flaps, the front access panel, the side access panels, and the front access flaps are formed as a single unit which is separable from the remaining panels of the container.

2. The container of claim 1, wherein the single sheet of foldable material is formed from a cellulose-based material.

3. The container of claim 1, wherein the cellulose based material is formed from at least one of a wood pulp, straw, cotton, and bagasse.

4. The container of claim 1, wherein the cellulose based material is in the form of at least one of a fiberboard, containerboard, corrugated containerboard and paperboard.

5. A display window container comprising:

a bottom panel having a pair of second side panels, a front panel having a pair of first side panels being foldably connected to the bottom panel, a rear panel having a pair of first side panels being foldably connected to the bottom panel wherein the bottom panel together with the pair of second side panels, the front panel, the rear panel, the pair of side panels and the first side panels form an interior space to contain products to display; and a top panel being formed opposite the bottom panel, the top panel being foldably connected to a pair of top panel flaps, a front access panel foldably connected to the top panel, the front access panel including two substantially similar front access flaps defined by two unparallel fold lines, said front access flaps each including an arcuate edge detachably connected to the front panel by a perforated line, the front access flaps being bounded by two side access panels and wherein the top panel together with the top panel flaps, the front access panel, the side access panels, and the front access flaps are formed as a single unit which upon pulling the front access panel during opening of the container, the two substantially similar front access flaps and the front access panel change from being in a flat position to a convex position with respect to one another and the front access flaps move inward which permits separation of the single unit from the remaining panels along the perforated lines.

6. The display window container of claim 5 further comprising an access hole defined by an edge of the front access panel.

* * * * *